US007425080B2

(12) United States Patent
Lin

(10) Patent No.: US 7,425,080 B2
(45) Date of Patent: Sep. 16, 2008

(54) TABLE LIGHT HAVING FUNCTION OF PLAYING SOUND

(76) Inventor: Jack Lin, 6F, No. 51, Lushin Street, Luchu Hsinag, Taoyuan Hsien (TW)

( * ) Notice: Subject to any disclaimer, the term of this patent is extended or adjusted under 35 U.S.C. 154(b) by 127 days.

(21) Appl. No.: 11/530,870

(22) Filed: Sep. 11, 2006

(65) Prior Publication Data

US 2007/0057776 A1 Mar. 15, 2007

(30) Foreign Application Priority Data

Sep. 13, 2005 (TW) ..... 94215734 U

(51) Int. Cl.
*F21V 33/00* (2006.01)

(52) U.S. Cl. ..... 362/86; 362/253; 455/344; 381/333; 381/388; 381/395; 381/124

(58) Field of Classification Search ..... 362/86.87, 362/253; 455/344; 381/301, 87, 333, 335, 381/386, 388, 390, 395, 124
See application file for complete search history.

(56) References Cited

U.S. PATENT DOCUMENTS 1,790,776 A * 2/1931 Thompson ..... 379/447
2,924,661 A * 2/1960 Messeas, Jr. ..... 381/388
3,082,839 A * 3/1963 Whitcas ..... 181/151
3,368,067 A * 2/1968 Paxinos ..... 362/253
4,953,223 A * 8/1990 Householder ..... 381/387
5,541,820 A * 7/1996 McLaughlin ..... 362/253
5,964,519 A * 10/1999 Chun-Ying ..... 362/253
6,238,061 B1 * 5/2001 McKenzie et al. ..... 362/253
2006/0209530 A1 * 9/2006 Schaak ..... 362/86

* cited by examiner

*Primary Examiner*—Laura Tso

(57) ABSTRACT

A table light combined with a sound-playing device includes a table light body and a sound-playing device (such as speakers) freely pivoted on a horizontal plane via pivotal shafts. Both ends of the table light base are transversely pivoted to a pair of speakers. A flexible supporting pipe extends from the pivoting portion with the distal end thereof connected to a fixing seat of the sound-playing device. The electronic lines and sound lines of the speakers are buried within the supporting pipe. The sound lines extend to the fixing seat and are electrically connected to the sound-playing device (such as MP3 player).

11 Claims, 6 Drawing Sheets

TABLE LIGHT HAVING FUNCTION OF PLAYING SOUND

BACKGROUND OF THE INVENTION

1. Field of the Invention

The present invention relates to a table light, and in particular to a table light combined with a sound-playing device.

2. Description of Prior Art

Music can cultivate people's temper. With the progress of technology, users can comfortably listen to the music via various kinds of electronic appliances at any time and places. Morning music should be moving and forceful to inspire the spirit. The melody of the music played in the working hours is brisk and harmonious to stabilize the mood. The music for helping sleep should be elegant and romantic to facilitate the relaxation of brain. Therefore, whenever and wherever, people like listening to music. In order to facilitate people to listen to the music, conventional sound-playing devices, such as MP3 player or CD player, are provided at places where people often do activities and accompanied with a set of speakers for playing sound.

At home or in an office, the conventional sound-playing devices and the speakers are provided on a desk or the head of a bed, so that people can listen to the sound with a more stereophonic effect. However, the space on the desk or the head of the bed is limited. Therefore, in order not to retard people to dispose affairs, the area of the base of the speaker is reduced and the weight thereof is also reduced as much as possible, so that people can easily move the speaker if necessary. However, this adversely makes the center of gravity of the speaker higher and thus the speaker is prone to topple over or deviate. On the other hand, since the wiring and electric lines extending from the speaker are also troublesome and the speaker may topple over due to a pulling action. The disordered lines will spoil the aesthetic feeling of the desk. In more cases, the lines of the sound-playing device and the speakers tangle with the lines of other electronic appliances on the desk.

A table light is also a necessary appliance on the desk. Similarly, in order to be easily disposed, the conventional structure of a table light reduces the area of its base as much as possible or increases the weight of the light base. Alternatively, a structure of a table light fixed by clipping is also proposed. However, the weights of a lamp cover and a bulb makes the total center of gravity high, so that the area of the light base cannot be unlimitedly reduced. A bulky light base is not easy to be moved and it also has a risk of falling accidentally. Finally, the table light fixed by clipping is prone to be damaged at the clipping portion thereof. Also, since the arm of force thereof (a distance from the fulcrum of the clipping portion to the clipping point) is shorter, it cannot support a larger table light.

More specifically, since the table light and the speakers are necessary appliances on the desk, they will occupy a large portion of the desk surface when both of them are disposed thereon. If the desk surface is too small or the documents disposed thereon are too many, the separated table light and speaker will be troublesome.

SUMMARY OF THE INVENTION

According to the above, if the speakers can be combined with the table light, the individual bases of the table light and the speakers can be also combined with each other to increase the supporting effect, so that the table light and the speakers are not prone to sway or topple over. Moreover, the lines of the speakers are buried into the connecting portion of the light base and the speaker, thereby to avoid the tangling lines from exposing on the desk to make the desk surface disordered. It also overcomes the problem caused by the tangling lines of the speakers and the table light. When the user is disposing affairs, it is unnecessary for him/her to worry about accidentally pulling the electronic lines to topple over the speaker or the light. More advantageously, after both appliances are combined into a single structure, more space on the desk surface can be released, so that the user can have more space to dispose his/her affairs. Further, a fixing support for a player can be provided on the combined structure of the table light and the speaker, so that a sound-playing device (such as MP3 player) can be easily disposed on the fixing support and connected with the speakers. Therefore, the combined structure has double functions.

According to the above, the present invention is to provide a structure of a table light combined with a speaker. With the combination of the speakers and the table light, the total base area and weight of the speakers and the table light can be enlarged to stabilize the whole structure without toppling over. As a result, the problem that the conventional speakers and the table light are prone to topple over is overcome. Further, since the electronic lines of the speakers and the light are buried in the main body of the combined structure, the user does not need to spent time for laying out these lines. Further, more space on the desk surface can be released. As a result, the combined structure can exhibit double functions (i.e. illuminating and sound-playing functions) and is very advantageous.

The present invention provides a housing constituted of a table light body and speakers pivotably connected on a horizontal surface via pivotal shafts. Both ends of the base of the table light are transversely pivoted to a speaker, respectively. The pivotal shaft extends a flexible supporting pipe to be connected to a fixing seat. The electronic lines of the speakers are buried in the main body. Sound lines extend to the fixing seat and are electrically connected to a sound player.

DETAILED DESCRIPTION OF THE INVENTION

Figure 1:
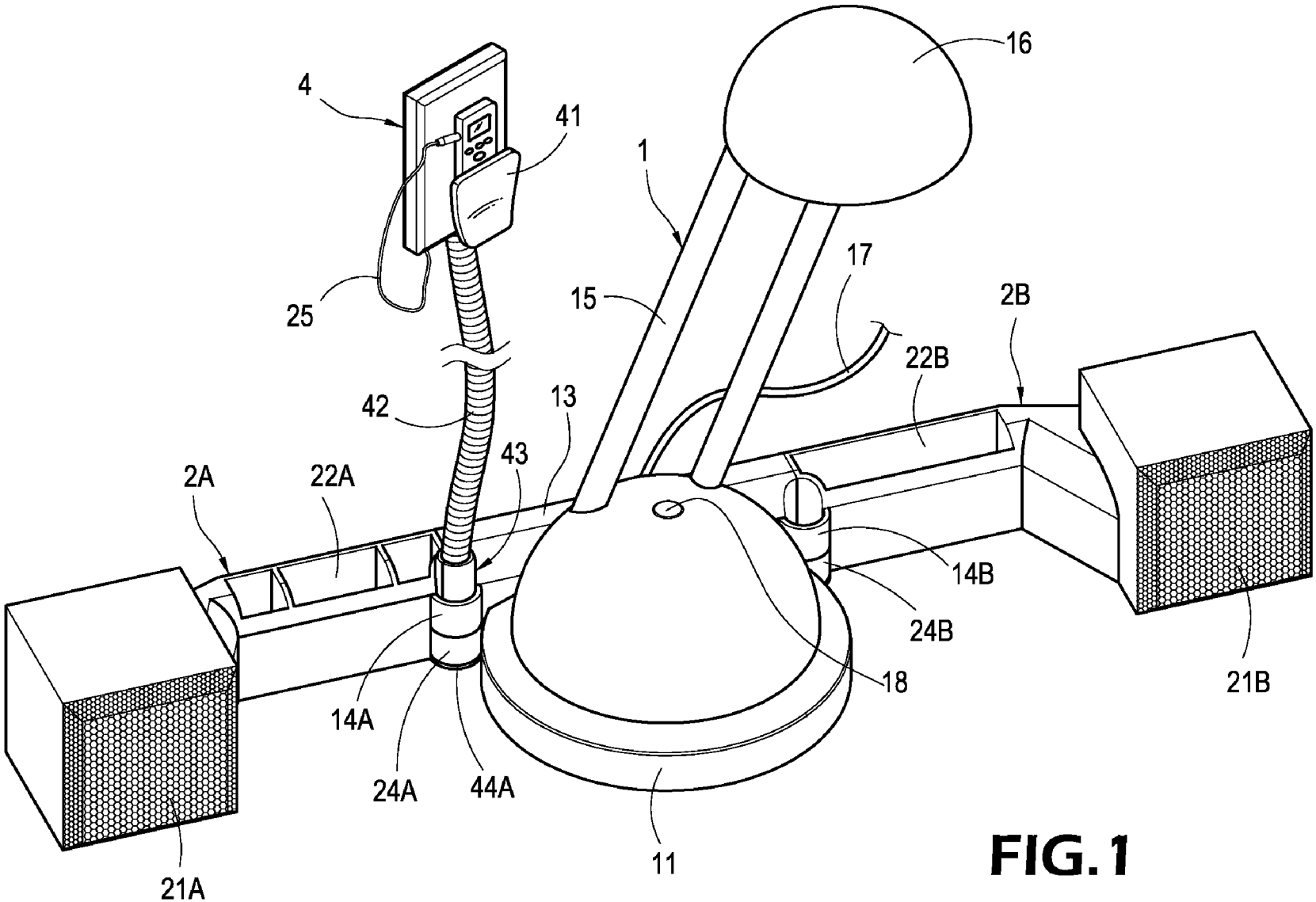
FIG. 1 is a perspective view of the present invention.

FIG. 1 is a perspective view of a preferred embodiment of the present invention. As shown in the figure, the present invention includes a table light body 1, two bridging portions 2 transversely extending in the right and left directions, and a player support 4. The table light body 1 is constituted of a pair of supporting arms 15 in a form of elongated rods with both ends thereof connected to a light cover 16 and a base 11. The bottom of the base 11 is slightly formed into a flat circle to be arranged on a plane. The center of the base is provided with a substantially hemispheric projecting portion, and a switch 18 for the table light is preferably provided thereon. The front side of one end of the pair of the supporting arms 15 is provided with a light cover 16, and the front side of the other end is connected to the projecting portion of the base 11. With this arrangement, a distance is maintained between the light cover and the plane. A bulb (not shown) is provided within the light cover 16. Finally, one side of the base 11 is connected to a rectangular back plate 13.

It should be noted that the table light body 1 is of a common structure and shape available in the market. There are various styles of table lights in commercial trade. Therefore, those skilled in this art can easily provide other kinds of table lights. However, such modification in the shape of the table light still falls into the scope of the present invention.

As shown in FIG. 1, a first bridging portion 2A and a second bridging portion 2B that are substantially symmetrical to each other are pivoted to the back plate 13, respectively, so that the two bridging portions 2A, 2B and the back plate 13 are located on the same straight line. The first bridging portion 2A is constructed of a substantially rectangular body, and the top thereof is recessed to provide at least one first trough 22A. The distal end of the first bridging portion is connected to a first speaker 21A. Similarly, the distal end of the second bridging portion 2B is provided with a second speaker 21B. Preferably, the top of the second bridging portion 2B is recessed to form a second trough 22B. A user can dispose articles into these troughs. For example, as to students or white-collar groups, writing utensils, notepapers or the like can be disposed in the troughs. Therefore, in order to correspond to various demands of users, the shape of the trough can be formed into various designs. Alternatively, the trough can be partitioned into several chambers to increase its purpose.

For those skilled in this art, it is apparent that the two bridging portions are described herein as rectangular bodies, however, the bridging portion can be formed into any suitable shape as long as it can bridge the speaker 21 and the base 11 without breaking the balance of total center of gravity. The shape of the speaker 21 can be also modified in various fashions. The speaker can be formed into any other suitable shapes as long as the combination of the speakers and the base 11 can achieve a stable structure to increase the area of the total base for disposing articles. Therefore, such modification in shape of the speaker still falls into the scope of the present invention.

As shown in FIG. 1, the player support 4 is connected to the distal end of a supporting pipe 42 extending from the pivotal shaft 24A of the table light body 1 and the first bridging portion 2A. The supporting pipe is a flexible supporting pipe used for supporting. Since the supporting pipe 42 is made of flexible materials, it will not be twisted and deformed due to the rotation of the pivotal shaft, and is fixed into the left pivotal shaft 24A. One end of the supporting pipe 42 is circumferentially provided with a tubular sleeve 43 and then penetrates into the pivotal shafts 14A, 24A, thereby to prevent the support 4 from swaying. The distal end of the support 4 is preferably a clipping tool 41 for clipping a player. The sound input interface such as the sound line 25 of the speakers 21 extends from the speakers through the two bridging portions 2A, 2B and the supporting pipe 42 and finally exposes at the distal end of the supporting pipe 42, so that an external player can be electrically connected with the speakers.

The present invention is directed to an electrical device powered by electricity, such as by batteries or an external power supply. Further, the table light and the speakers can preferably use the same power input 17. However, if the speaker is to achieve a high quality of output efficiency or the power consumption rate (Wattage) of the bulb is large, separated power inputs can be used. Therefore, the present invention is not limited to a single power input.

Figure 2:
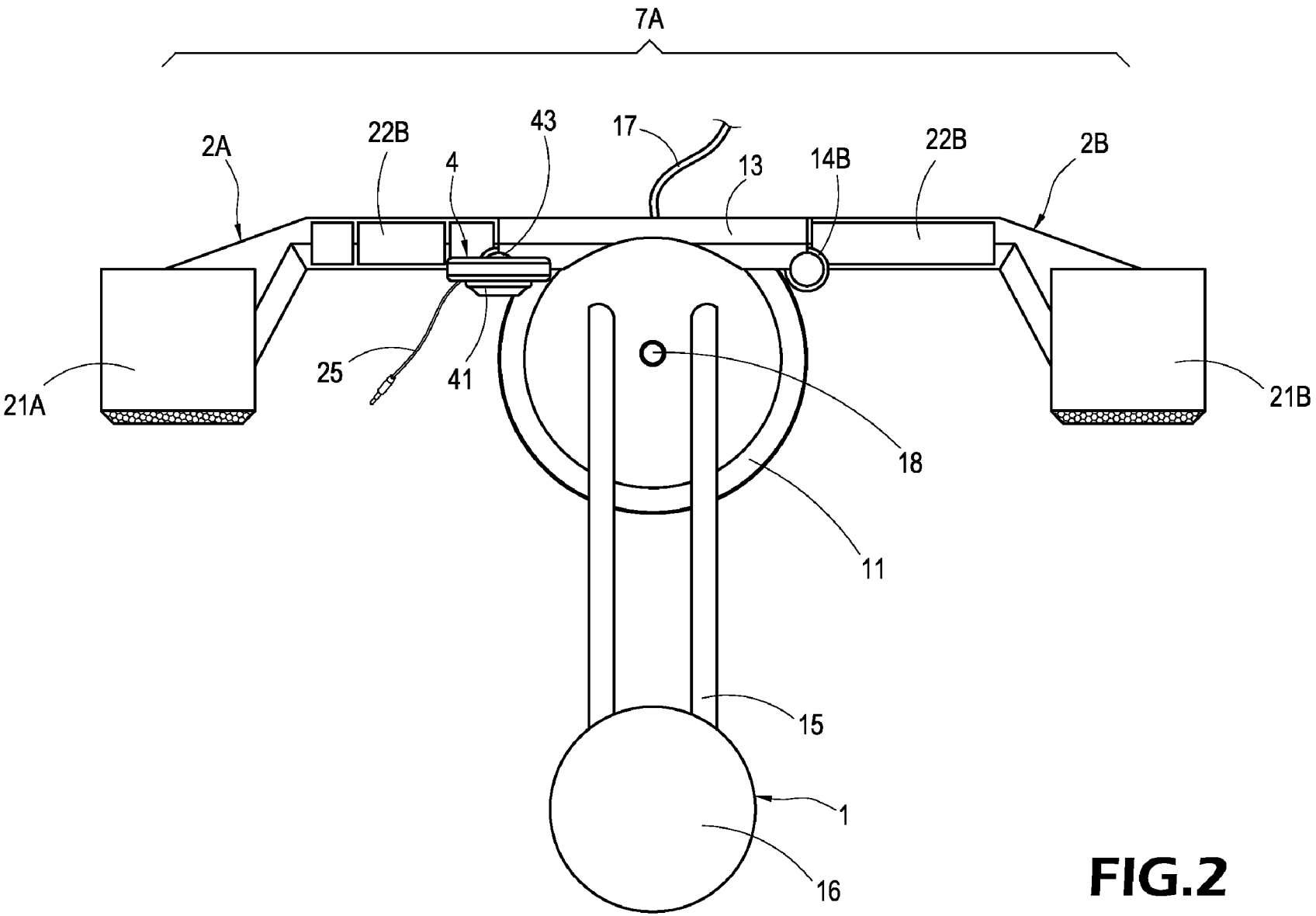
FIG. 2 is a top view of the present invention in an unfolded state.
Figure 3:
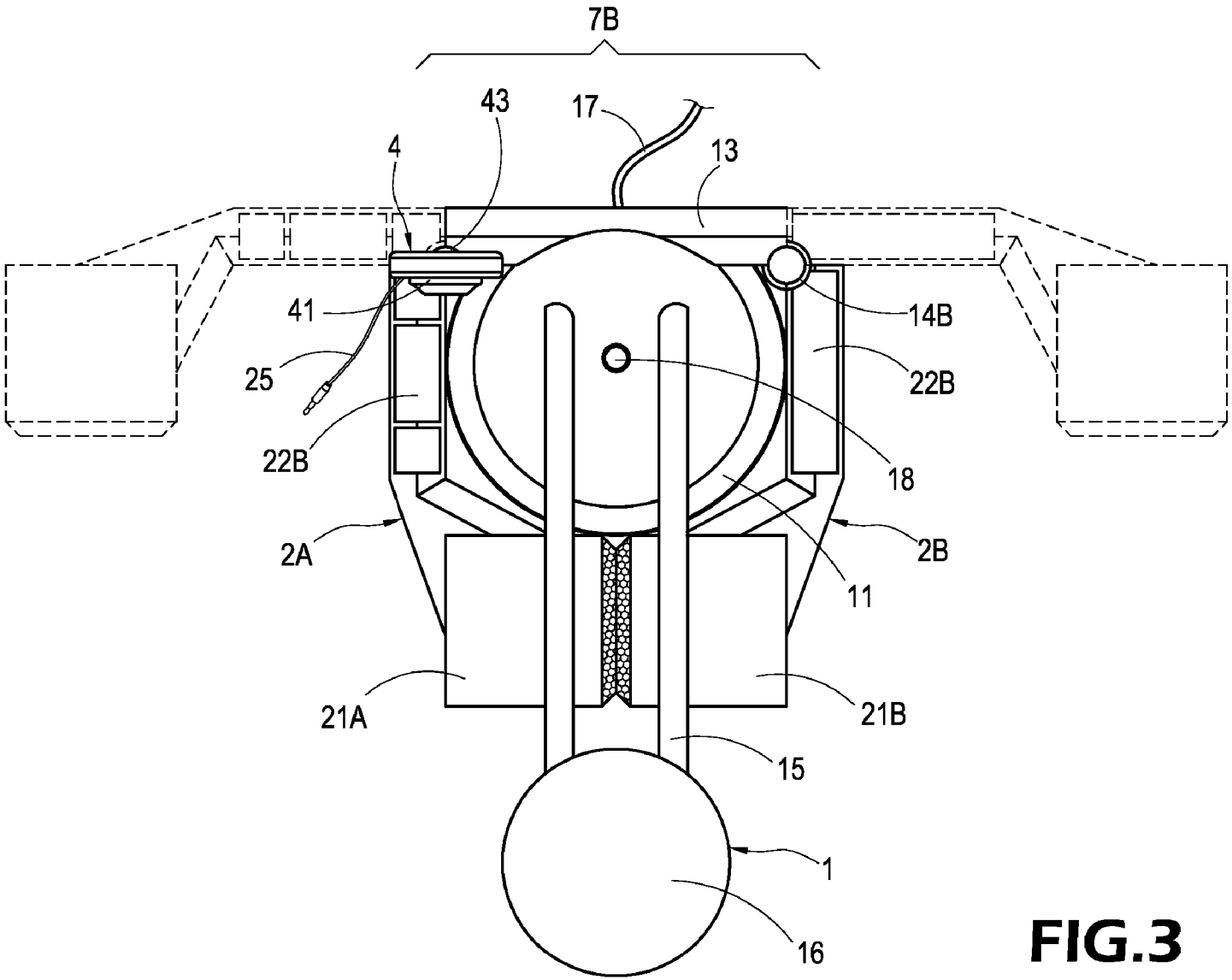
FIG. 3 is a top view of the present invention in a folded state.

FIG. 2 and FIG. 3 are top views showing an unfolded state 7A and a folded state 7B of the table light having a function of playing sound in accordance with the present invention, respectively. In this preferred embodiment, as shown in FIG. 2, the two bridging portions 2A, 2B and the back plate 13 are substantially located on the same straight line. Practically, it is acceptable if the angle between the two bridging portions 2A, 2B is within 150 to 180 degrees. FIG. 3 shows the folded state 7B of the present invention by solid lines. The two bridging portions 2A, 2B are formed into nearly parallel bridging portions via the rotation of the pivotal shafts 24, 14. The sound output ports of the left and right speakers 21A, 21B substantially correspond to and nearly contact with each other. Therefore, the two bridging portions 2A, 2B can freely rotate to a plurality of degrees between the unfolded state 7A and the folded state 7B via the pivotal shafts 24, 14. In this way, the present invention can be adjusted according to various demands. For example, when the space on the desk surface is insufficient and thus the present invention cannot be fully folded into the state 7A, the present invention can be still adjusted to a suitable state depending on the actual space.

Figure 4:
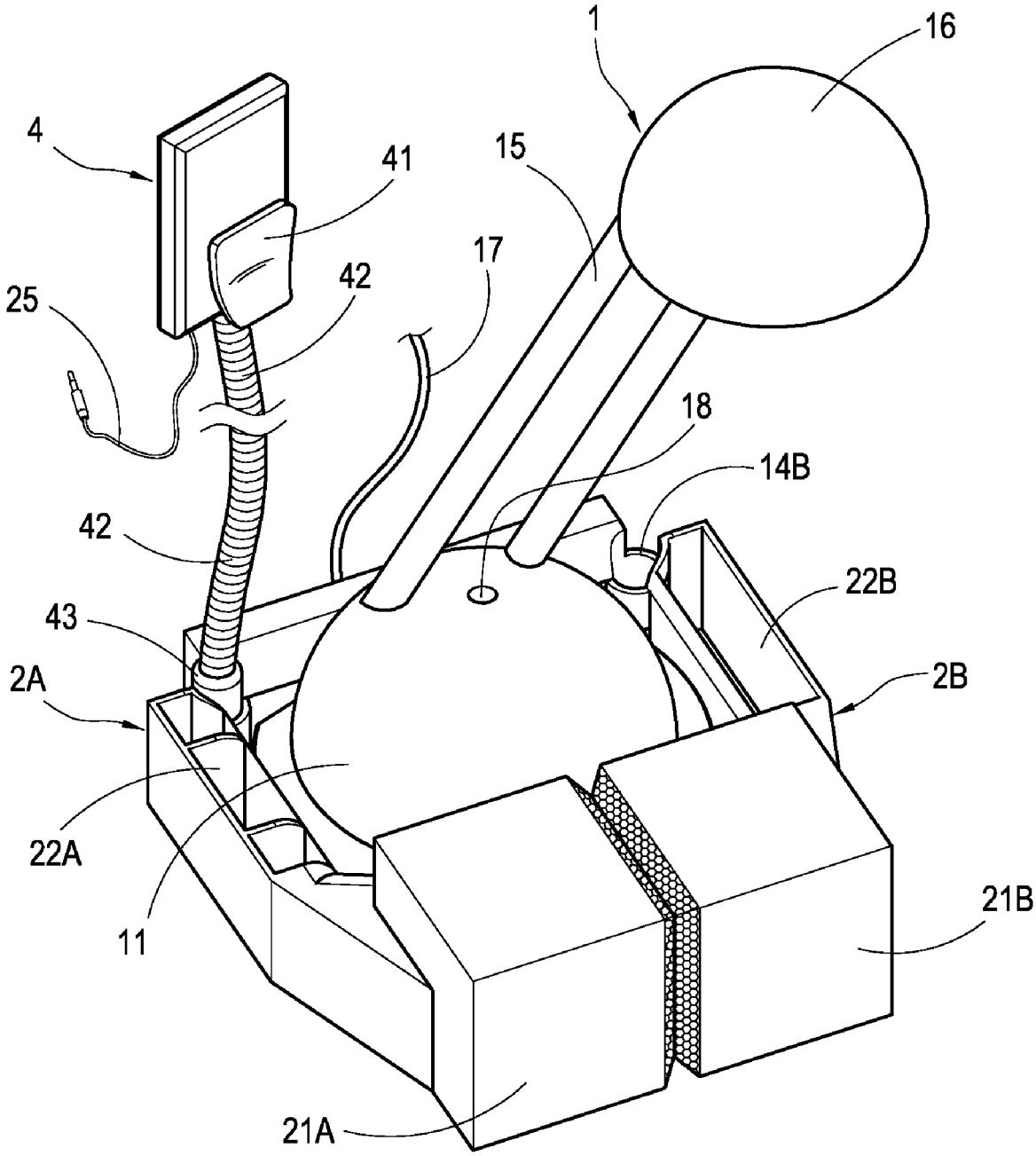
FIG. 4 is a perspective view of the present invention in a folded state.

FIG. 4 is a perspective view showing a folded state 7B of the table light having a function of playing sound in accordance with the present invention. As shown in the figure, since the first bridging portion 2A and the second bridging portion 2B substantially encircle the base 11 of the table light to increase the supporting area of the base of the table light. Therefore, the table light has a more stable supporting structure and is not prone to topple over due to the weight of the light. Further, in comparison with the conventional structure in which the speakers and the light are separated, the folded state 7B has a smaller space and cost for packaging, and thus delivery cost and package expense can be saved.

Figure 5:
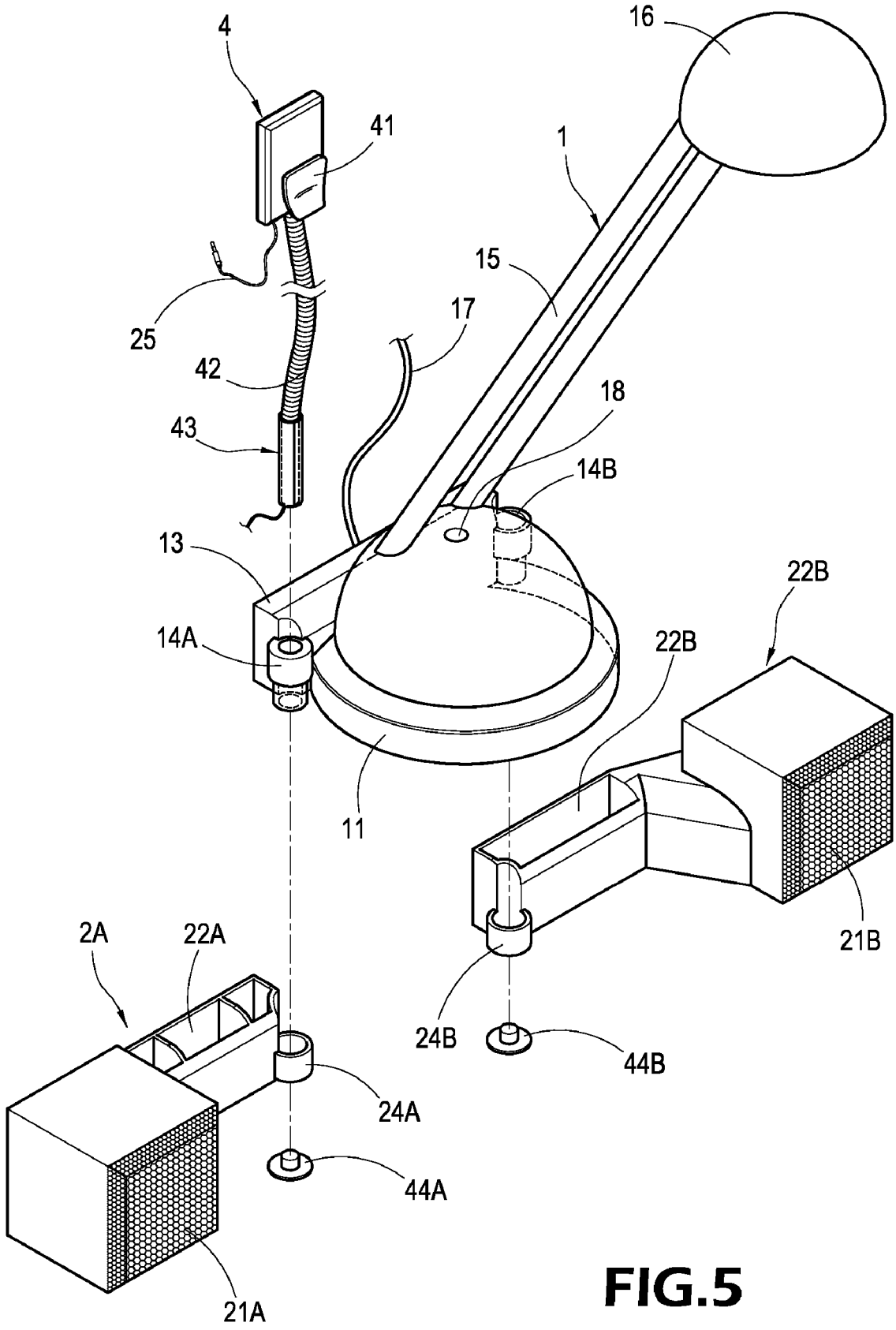
FIG. 5 is an exploded view of the present invention.
Figure 6:
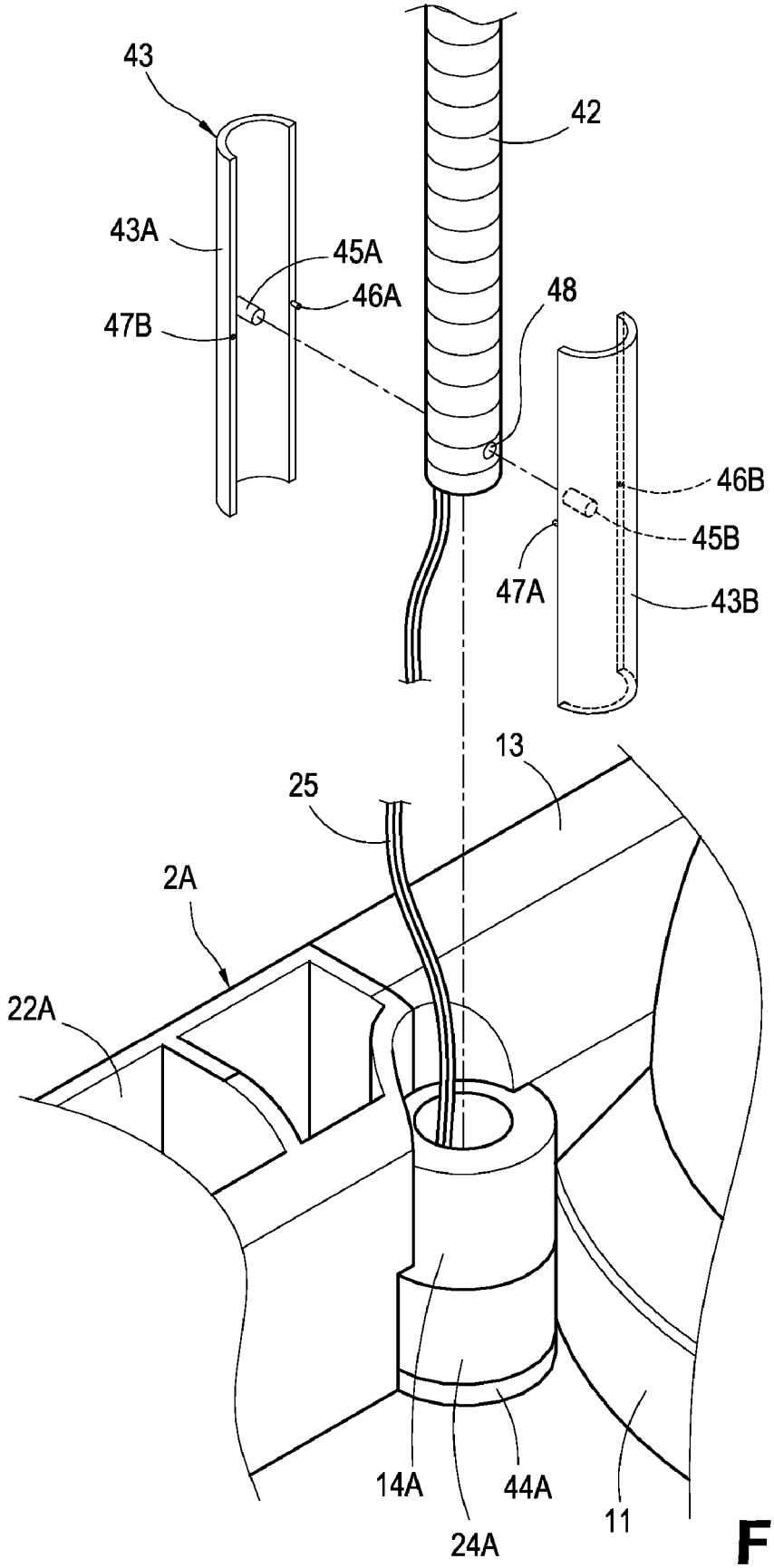
FIG. 6 is a partially enlarged view of the pivoting portion of the present invention.

With reference to FIG. 5 and FIG. 6, FIG. 5 is an exploded view showing the primary members of the preferred embodiment of the present invention. The first pivotal shaft 14A of the table light is formed into a substantially tubular casing. The tubular casing is divided into an upper portion and a lower portion having a substantially identical inner diameter. The outer diameter of the lower half portion is smaller than the outer diameter of the upper half portion, and the outer diameter of the lower half portion is slightly smaller than the inner diameter of the left pivotal shaft 24A. Finally, the distal end of the left pivotal shaft 24A has a locking element, such as a locking cap formed into an inverted T letter. Therefore, the first pivotal shaft 14A of the table light can be formed into a pivoting body with its lower half portion movably pivoted to the left pivotal shaft 24A. Finally, the sleeve penetrates into the hole of the pivotal shaft with a locking cap 44A locked to the distal end of the left pivotal shaft 24A. With reference to the assembly view in FIG. 6, the pivoting connection between the second bridging portion 2B and the base 11 is similar to that between the first bridging portion 2A and the base 11. Therefore, the description thereof is omitted for simplicity.

FIG. 6 is an enlarged view of the pivotal shaft. The sleeve 43 is a tubular casing formed by locking two front and rear semicircular casings (i.e., first casing 43A and second casing 43B). The corresponding surfaces of the semicircles are provided with a pin rod 45A, 45B, respectively, to correspond to a pinhole 48 on the supporting pipe 42. Further, the edges of the semicircles 43A and 43B are provided with protruding shafts 46A, 47A and recessed holes 46B, 47B, respectively. With the insertion of the protruding shafts and the recessed holes, the sleeve 43 can be circumferentially fixed to the supporting pipe 42.

Although the present invention has been described with reference to the foregoing preferred embodiments, it will be understood that the invention is not limited to the details thereof. Various equivalent variations and modifications can still be occurred to those skilled in this art in view of the teachings of the present invention. Thus, all such variations and equivalent modifications are also embraced within the scope of the invention as defined in the appended claims.

What is claimed is:

1. A table light having a function of playing sound, comprising:

a base;

a light cover provided with a bulb therein; and a supporting arm connected between the base and the light cover for supporting the light cover on the base;

wherein the base is provided with speakers, and the speakers are electrically connected to a sound input interface externally exposed to the table light, where a rectangular bridging portion extends outwardly from the base, and the speaker is connected onto the bridging portion.

2. The table light having a function of playing sound according to claim 1, further comprising a playing unit support for holding a sound-playing unit.

3. The table light having a function of playing sound according to claim 2, wherein the support is a clipping tool.

4. The table light having a function of playing sound according to claim 1, wherein the bridging portion is formed integrally with the base.

5. The table light having a function of playing sound according to claim 1, wherein the bridging portion is pivoted to the base.

6. The table light having a function of playing sound according to claim 5, further comprising a playing unit support provided on the pivoting portion for holding a sound-playing unit.

7. The table light having a function of playing sound according to claim 1, wherein the bridging portion has a first bridging portion and a second bridging portion extending outwardly from both sides of the base.

8. The table light having a function of playing sound according to claim 7, wherein the two bridging portions are substantially located on the same straight line.

9. The table light having a function of playing sound according to claim 7, wherein the angle between the two bridging portions is within the range of 150 to 180 degrees.

10. The table light having a function of playing sound according to claim 1, wherein the bridging portion is substantially formed into a rectangular body.

11. The table light having a function of playing sound according to claim 1, wherein the bridging portion is provided with a trough thereon.

* * * * *